US007434505B2

(12) United States Patent
Suzuki et al.

(10) Patent No.: US 7,434,505 B2
(45) Date of Patent: Oct. 14, 2008

(54) SERVO PRESS CONTROL SYSTEM AND SERVO PRESS CONTROL METHOD

(75) Inventors: Yuichi Suzuki, Komatsu (JP); Yukio Hata, Kagashi Ishikawa (JP)

(73) Assignees: Komatsu Ltd., Tokyo (JP); Komatsu Industries Corporation, Komatsu-shi (JP)

( * ) Notice: Subject to any disclaimer, the term of this patent is extended or adjusted under 35 U.S.C. 154(b) by 22 days.

(21) Appl. No.: 11/575,210

(22) PCT Filed: Sep. 2, 2005

(86) PCT No.: PCT/JP2005/016086

§ 371 (c)(1),
(2), (4) Date: Mar. 13, 2007

(87) PCT Pub. No.: WO2006/030649

PCT Pub. Date: Mar. 23, 2006

(65) Prior Publication Data

US 2008/0034985 A1 Feb. 14, 2008

(30) Foreign Application Priority Data

Sep. 15, 2004 (JP) ..... 2004-268003

(51) Int. Cl.
*B30B 15/26* (2006.01)

(52) U.S. Cl. ..... 100/43; 100/35; 100/281; 72/14.8; 72/20.1; 72/443; 700/206

(58) Field of Classification Search ..... 100/35, 100/43, 281; 72/14.8, 14.9, 20.1, 20.4, 21.1, 72/21.4, 21.6, 441, 443, 446; 700/19, 206; 318/560, 567, 568.1
See application file for complete search history.

(56) References Cited

U.S. PATENT DOCUMENTS

| | | | | |
|---|---|---|---|---|
| 6,970,767 | B2 * | 11/2005 | Teraoka | 700/206 |
| 7,293,500 | B2 * | 11/2007 | Futamura et al. | 100/49 |
| 2005/0081587 | A1 * | 4/2005 | Suzuki et al. | 72/20.1 |
| 2007/0006629 | A1 * | 1/2007 | Iwashita et al. | 72/351 |

FOREIGN PATENT DOCUMENTS

| | | | |
|---|---|---|---|
| JP | 2003-154498 | A | 5/2003 |
| JP | 2003-305599 | A | 10/2003 |
| JP | 2004-017098 | A | 1/2004 |

* cited by examiner

*Primary Examiner*—Jimmy T Nguyen
(74) *Attorney, Agent, or Firm*—Frishauf, Holtz, Goodman & Chick, P.C.

(57) ABSTRACT

High production processing and high accuracy processing are selectively performed with a single press. To this end, there are provided a system and method for controlling a servo press 1 in which an eccentric rotation mechanism 20 is driven by a servo motor 21 and the rotating power of the eccentric rotation mechanism 20 is transmitted to a slide 3 through a toggle linkage 15, thereby vertically moving the slide 3. In the control system and method, the rotation of the servo motor 21 is controlled in response to a motor speed command rm calculated based on the deviation ϵ p of the position of the slide 3 and a positional gain G(θ) preset according to a speed ratio of the slide 3.

2 Claims, 9 Drawing Sheets

4 (a)

4 (b)

5 (a)

5 (b)

9 (a)

9 (b)

SERVO PRESS CONTROL SYSTEM AND SERVO PRESS CONTROL METHOD

This application is a U.S. National Phase Application under 35 USC 371 of International Application PCT/JP2002/016086 filed Sep. 2, 2005.

TECHNICAL FIELD

The present invention relates to a system and method for controlling a servo press which has an eccentric rotation mechanism, linkage or the like as a power transmission mechanism and in which the relationship between the rotation angle of the servo motor and the position of the slide is nonlinear.

BACKGROUND ART

There have heretofore been known a servo press in which an eccentric rotation mechanism is driven by a servo motor and the rotating power of the eccentric rotation mechanism is transmitted to a slide through a toggle linkage thereby moving the slide up and down (e.g., Patent Document 1). Since this servo press is able to vertically move the slide at high speed by the continuous rotation of the servo motor, it can perform high-production industrial processing.

Another known servo press is configured such that the rotating power of the servo motor is converted into a substantially horizontal linear movement by a ball screw mechanism and this linear movement is in turn converted into a vertical movement by a toggle linkage to vertically move the slide (e.g., Patent Document 2). In this servo press, a conversion equation is prestored for calculating the substantial positional gain of a slide position obtained from a relational expression representative of the relationship between the position of the slide and the position of the ball screw or nut. During actual control of the slide, the positional gain is corrected according to the position of the slide, using the conversion equation for the substantial positional gain, and a motor speed command is calculated from the deviation of the position of the slide and the corrected positional gain to control the servo motor. This servo press is capable of accurately positioning the slide so that high-accuracy processing can be properly performed.

| | |
|---|---|
| Patent Document 1: | JP-A-2004-17098 |
| Patent Document 2: | JP-A-2003-305599 |

DISCLOSURE OF THE INVENTION

Problems that the Invention Intends to Solve

However, the servo press disclosed in Patent Document 1 has revealed the following disadvantage. The speed ratio Vmax/V (the ratio between the speed of the slide V at a certain time point when the rotation speed of the servo motor is constant and the maximum speed Vmax of the slide obtainable by this rotation speed) of the slide varies according to the posture of the toggle linkage. Therefore, when performing feedback control based on the position of the slide, positioning of the slide cannot be carried out with high accuracy.

The servo press disclosed in Patent Document 2 is able to position the slide with high accuracy because the servo motor is controlled with a motor speed command calculated from the deviation of the position of the slide and a positional gain after correction. However, the vertical movement of the slide is accompanied with reversing of the rotation of the servo motor so that acceleration/deceleration and stopping operation of the servo motor become necessary. This is an obstacle to high-speed driving of the slide and therefore high production processing cannot be satisfactorily performed.

The invention is directed to overcoming the foregoing problems and a primary object of the invention is therefore to provide a servo press control system and servo press control method which enable it to selectively perform high production processing and high accuracy processing with a single press.

Means of Solving the Problems

In accomplishing the above object, there has been provided, in accordance with a first aspect of the invention, a system for controlling a servo press in which an eccentric rotation mechanism is driven by a servo motor, the rotation of which is controlled by a servo amplifier which receives a motor speed command, and rotating power of the eccentric rotation mechanism is transmitted to a slide through a connecting rod or linkage, thereby vertically moving the slide, comprising:

(a) a slide position detector for detecting a position of the slide;

(b) a slide position deviation computing unit for calculating deviation of the slide position detected by the slide position detector from a target slide position;

(c) a positional gain computing unit for calculating a positional gain according to a speed ratio of the slide; and (d) a motor speed instructing unit for calculating a motor speed command based on the slide position deviation calculated by the slide position deviation computing unit and the positional gain calculated by the positional gain computing unit and outputting the calculated motor speed command to the servo amplifier.

According to a second aspect of the invention, there is provided a method for controlling a servo press in which an eccentric rotation mechanism is driven by a servo motor, and rotating power of the eccentric rotation mechanism is transmitted to a slide through a connecting rod or linkage, thereby vertically moving the slide, wherein rotation of the servo motor is controlled in response to a motor speed command calculated based on deviation of a position of the slide and a positional gain corresponding to a speed ratio of the slide.

EFFECTS OF THE INVENTION

According to the first and second aspects, since the eccentric rotation mechanism is driven by a servo motor, the rotation of which is controlled by a servo amplifier which has received a motor speed command and the rotating power of the eccentric rotation mechanism is transmitted to the slide through a connecting rod or linkage thereby vertically moving the slide, the slide can be vertically moved at high speed by continuous rotation of the servo motor to properly perform high production processing. In addition, since the rotation of the servo motor is controlled by a motor speed command calculated based on the deviation of the position of the slide and a positional gain corresponding to a speed ratio of the slide, the slide can be positioned with high accuracy to properly perform high accuracy processing. Accordingly, the invention has the effect of selectively performing high production processing and high accuracy processing with a single press. It should be noted that the speed ratio of the slide is the ratio (Vmax/V) between the speed V of the slide at a certain time point when the rotation speed of the servo motor is constant and the maximum speed Vmax of the slide obtained by this rotation speed.

EXPLANATION OF REFERENCE NUMERALS

Figure 1:
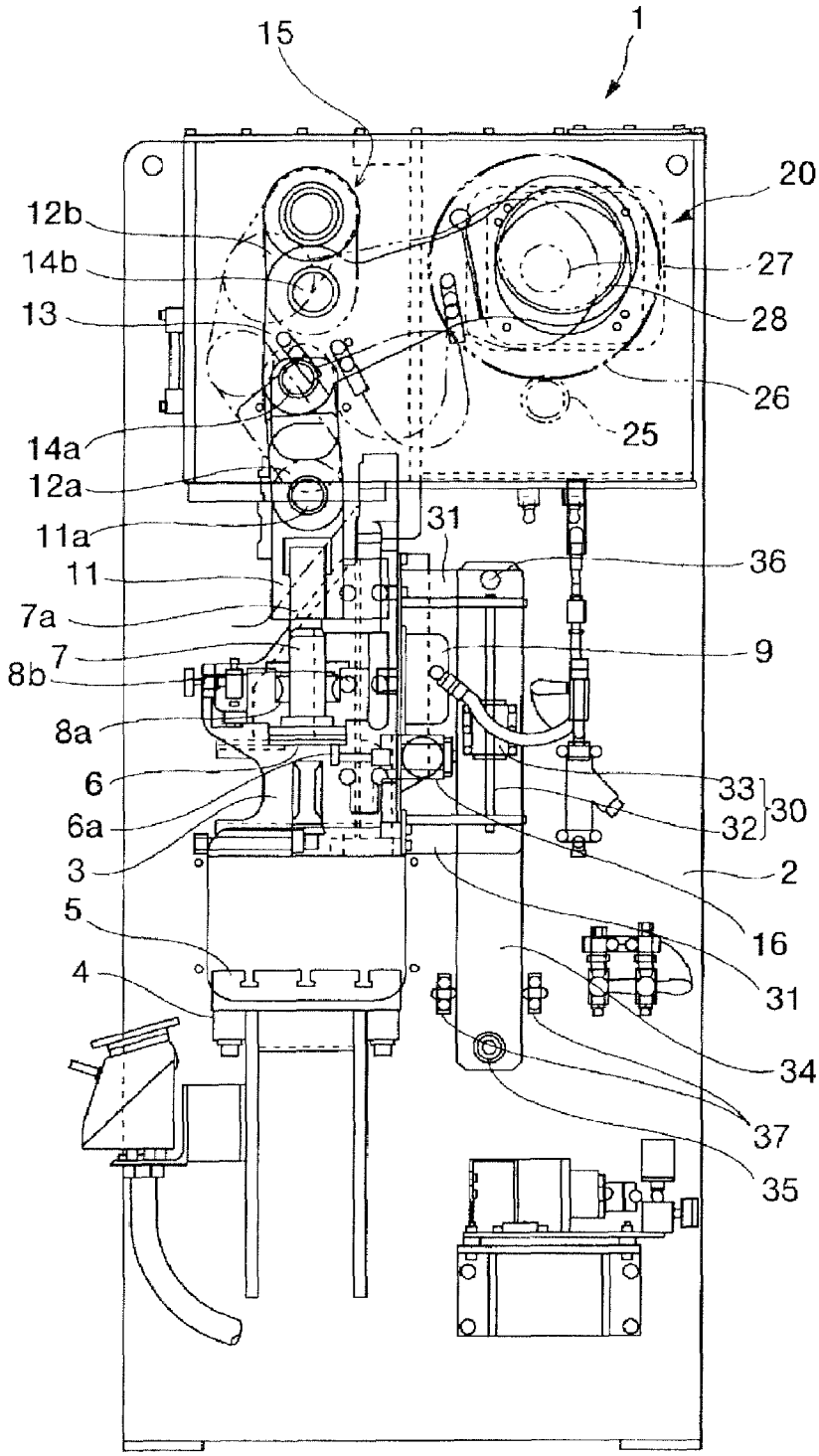
FIG. 1 is a partly sectional side view of a servo press according to a first embodiment of the invention.

1, 1A: servo press
3: slide
15: toggle linkage
20, 20A: eccentric rotation mechanism
21: servo motor
30: slide position detector
40: control system
43: servo amplifier
58: slide position deviation computing unit
59: positional gain computing unit
60: motor speed instructing unit
74: connecting rod

BEST MODE FOR CARRYING OUT THE INVENTION

Referring now to the accompanying drawings, preferred embodiments of the servo press control system and servo press control method of the invention will be concretely described below.

First Embodiment

Figure 2:
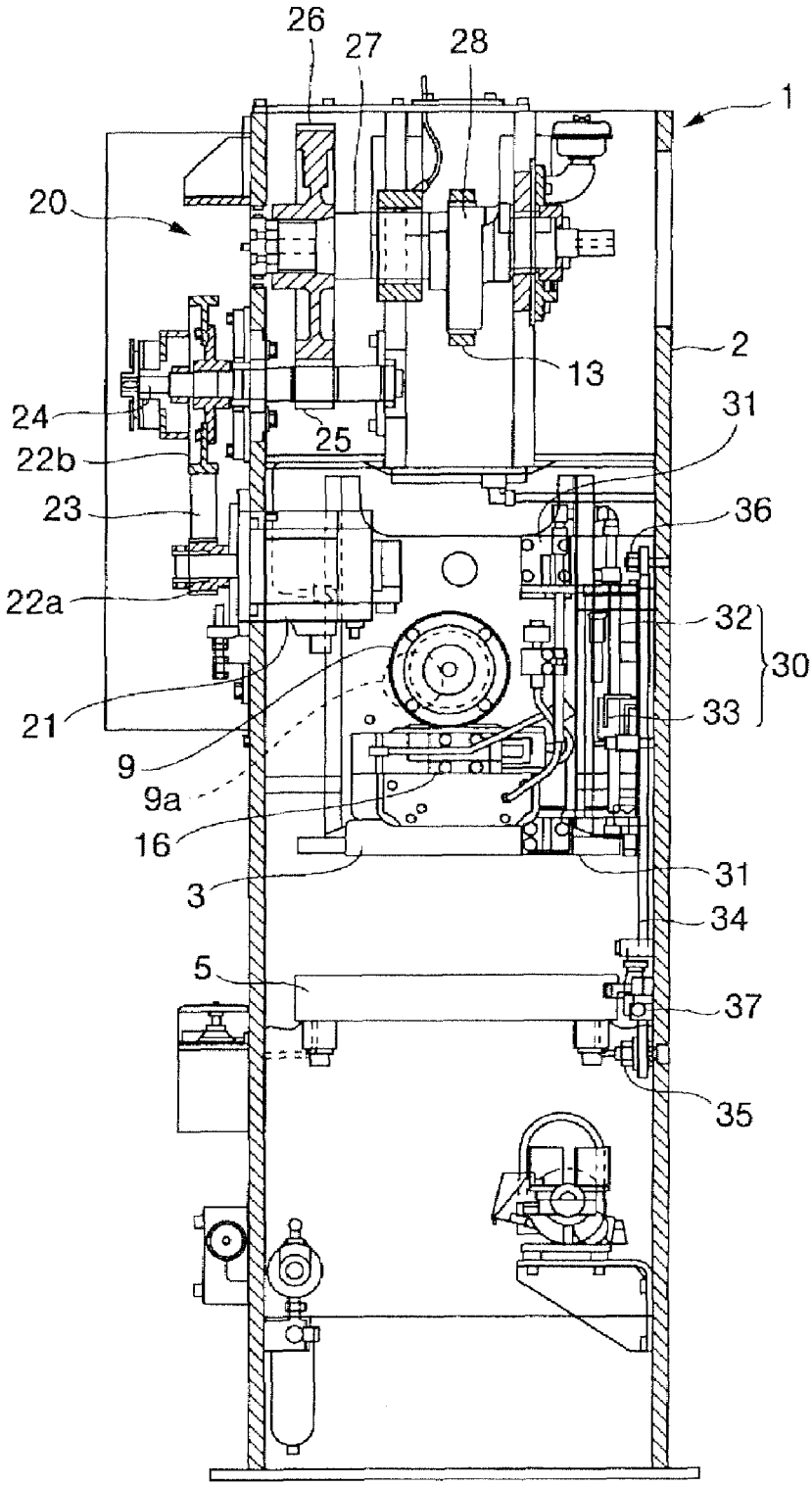
FIG. 2 is a partly sectional rear view of the servo press according to the first embodiment.

FIGS. 1, 2 are a partly sectional side view and partly sectional rear view, respectively, of a servo press according to a first embodiment of the invention.

In a servo press 1 according to the first embodiment, a slide 3 is supported on the substantial center of a body frame 2 so as to be vertically movable. A bed 4 is disposed under the body frame 2. A bolster 5 is mounted on the bed 4 so as to face the slide 3. A threaded shaft 7 for die height adjustment is pivotally inserted into a hole formed in the upper part of the slide 3 such that the main body of the threaded shaft 7 is prevented from coming off. The threaded shaft 7 has a threaded portion 7*a* which extends upward, getting out of the slide 3 and is screwed into a female screw part formed in the lower part of a plunger 11 disposed above the threaded portion 7*a*.

A worm wheel 8*a* is fitted on the outer circumference of the main body of the threaded shaft 7. A worm 8*b* screwed into the worm wheel 8*a* is coupled to the output shaft of an induction motor 9 through a gear 9*a*, the induction motor 9 being attached to the rear face of the slide 3. Herein, the induction motor 9 is formed into a compact flat shape and is short in length in an axial direction.

The upper part of a plunger 11 is pivotally coupled to one end of a first link 12*a* with a pin 11*a*. The other end of the first link 12*a* is pivotally coupled to the lower part of a first side of a triaxial link 13 with a pin 14*a*. The upper part of the first side of the triaxial link 13 is pivotally coupled to one end of a second link 12*b* with a pin 14*b*. The other end of the second link 12*b* is pivotally coupled to the upper part of the body frame 2. A second side of the triaxial link 13 is pivotally coupled to an eccentric shaft 28 described later. Thus, a toggle linkage 15 (which corresponds to "the linkage" of the invention) is constituted chiefly by the first link 12*a*, the second link 12*b* and the triaxial link 13.

A servo motor (AC servo motor) 21 for driving the slide is attached to a side face of the body frame 2, with the center of axle directed in a lateral direction of the press. A belt 23 (a timing belt is usually used as the belt 23) passes around a first pulley 22*a* attached to the output shaft of the servo motor 21 and a second pulley 22*b* attached to an intermediate shaft 24 which is rotatably placed above the servo motor 21 with the center of its axle directed in a lateral direction of the press. A drive shaft 27 is rotatably supported on the body frame 2 at a position above the intermediate shaft 24. A gear 26 fixed to one end of the drive shaft 27 meshes with a gear 25 fixed to the intermediate shaft 24. An eccentric shaft 28 is provided at the substantial center of the drive shaft 27 when viewed in an axial direction. This eccentric shaft 28 is pivotally coupled to the second side of the triaxial link 13. Accordingly, an eccentric rotation mechanism 20 is constructed by a power transmission mechanism which extends from the output shaft of the servo motor 21 to the eccentric shaft 28. The eccentric rotation mechanism 20 is driven by the servo motor 21 and the rotating power of the eccentric rotation mechanism 20 is transmitted to the slide 3 through the toggle linkage 15, thereby moving the slide 3 up and down.

Formed within the slide 3 is an oil chamber 6 which is hermetically closed by the lower end face of the threaded shaft 7. The oil chamber 6 is connected to a switching valve 16 through an oil path 6*a* formed within the slide 3. The switching valve 16 operates to switch the supply/discharge of operating oil to and from the oil chamber 6. During pressing operation, the operating oil supplied to the oil chamber 6 through the switching valve 16 is kept within the oil chamber 6 and the pressure exerted during pressurization is transmitted to the slide 3 by means of the oil within the oil chamber 6. If overload is imposed on the slide 3 and the oil pressure in the oil chamber 6 exceeds a specified value, the oil within the oil chamber 6 is allowed to return from a relief valve (not shown) to a tank, so that the pressure working on the slide 3 and other members is mitigated to prevent damage to the slide 3 and the dies (not shown in the drawings).

Disposed behind the slide 3 is a slide position detector 30 for detecting the position of the slide 3. The slide position detector 30 is composed of a slide position sensor 33 consisting of a non-contact type linear sensor or the like and a position detecting rod 32 which is vertically movably inserted into the main body of the slide position sensor 33 and has a scale for position detection. The slide position sensor 33 is securely attached to an auxiliary frame 34 provided on a side face of the body frame 2. The auxiliary frame 34 is long in a vertical direction. The lower part of the auxiliary frame 34 is securely attached to the side face of the body frame 2 with a bolt 35, whereas its upper part is supported by a bolt 36 so as to be slidable in a vertical direction, the bolt 36 being inserted in a vertical long hole (not shown). A side of the auxiliary frame 34 is in contact with and supported by a front and rear pair of supporting members 37. The position detection rod 32 is mounted on a position between an upper and lower pair of brackets 31 which project from upper and lower positions on the rear face of the slide 3 toward the side face of the body frame 2.

Only either one (the lower end in this embodiment) of the upper and lower ends of the auxiliary frame 34 is fixed to the body frame 2 with the other end being supported so as to be vertically movable, so that the auxiliary frame 34 is not affected by the expansion and contraction of the body frame 2 caused by variations in temperature. As a result, the slide position sensor 33 can correctly detect the position of the slide and die height without being affected by the expansion and contraction of the body frame 2 caused by variations in temperature.

Figure 3:
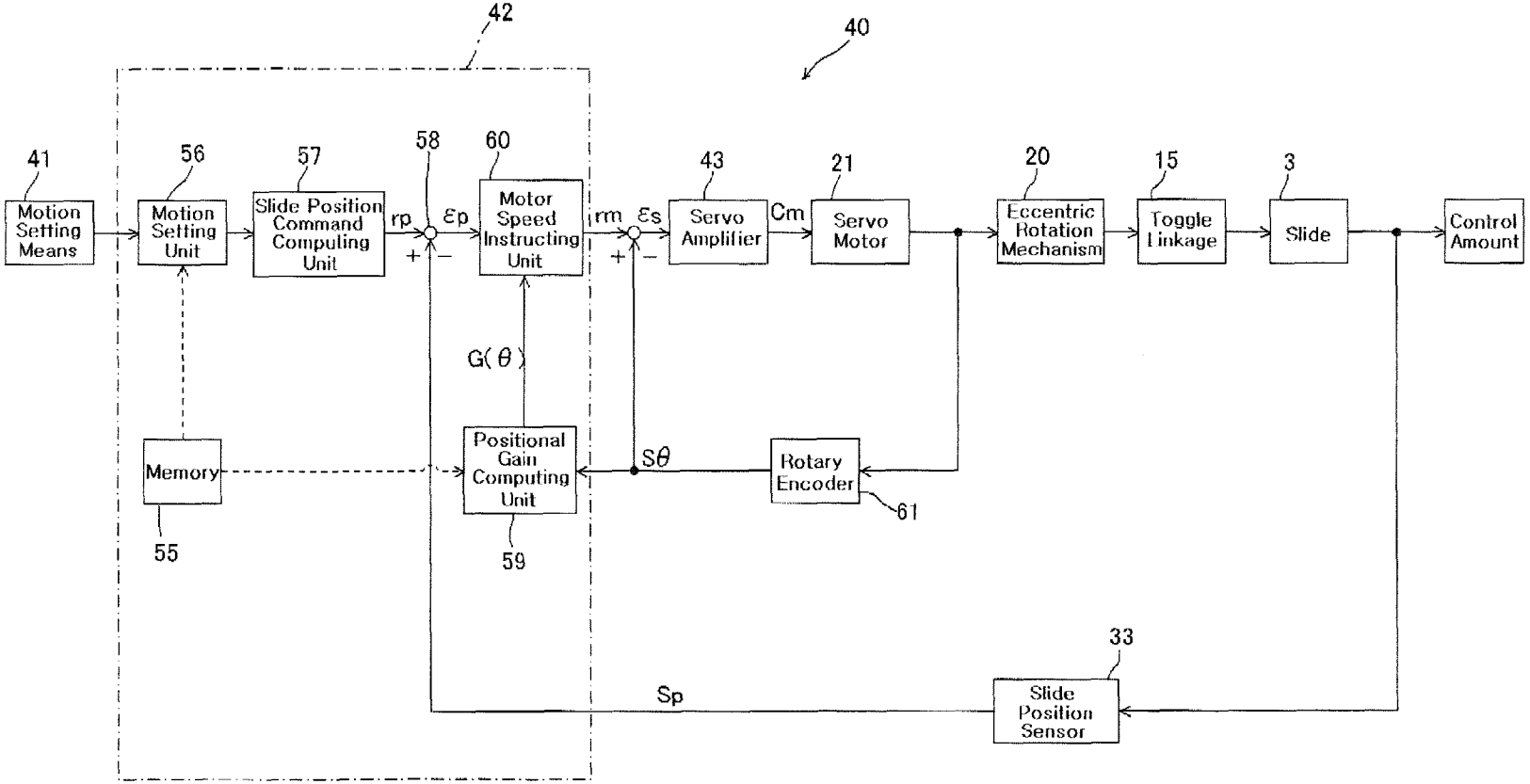
FIG. 3 is a block diagram schematically showing a configuration of a servo press control system according to the first embodiment.

FIG. 3 is a block diagram schematically showing the configuration of a servo press control system according to the first embodiment.

The control system 40 shown in FIG. 3 has a controller 42 and a servo amplifier 43. The controller 42 inputs a motion setting signal from a motion setting means 41 and a slide position signal indicative of a slide position detected by the slide position sensor 33. The servo amplifier 43 controls the rotation of the servo motor 21 based on a motor speed command signal output from the controller 42.

The motion setting means 41 inputs various data to set a slide motion and has a switch and/or a numeric key pad for entering motion data and a display unit for displaying the input data and set data which have been registered after completion of setting. In the first embodiment, the motion setting means 41 is composed of a programmable display unit with a so-called touch panel and a numerical keypad. This programmable display unit is formed such that a transparent touch switch panel is attached to the front face of a graphic display unit such as a liquid crystal display unit or plasma display unit. The motion setting means 41 may include a data input unit for inputting data from an external storage medium such as an IC card which stores preset motion data or a communication device for transmitting and receiving data though radio waves or a communication line.

This motion setting means 41 is designed to select and set either "rotation" or "reverse rotation" as a processing pattern corresponding to molding conditions, that is, a slide control pattern. Each slide control pattern will be described below.

Figure 4:
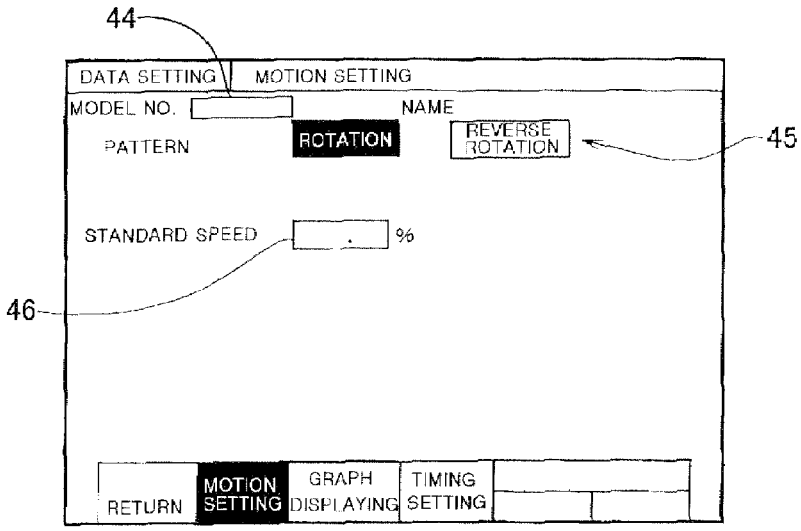
FIG. 4 is a diagram (FIG. 4(*a*)) showing, as an example, a motion setting screen for a "rotation" pattern according to the first embodiment and an explanatory diagram (FIG. 4(*b*)) showing an operation in the "rotation" pattern.
Figure 4:
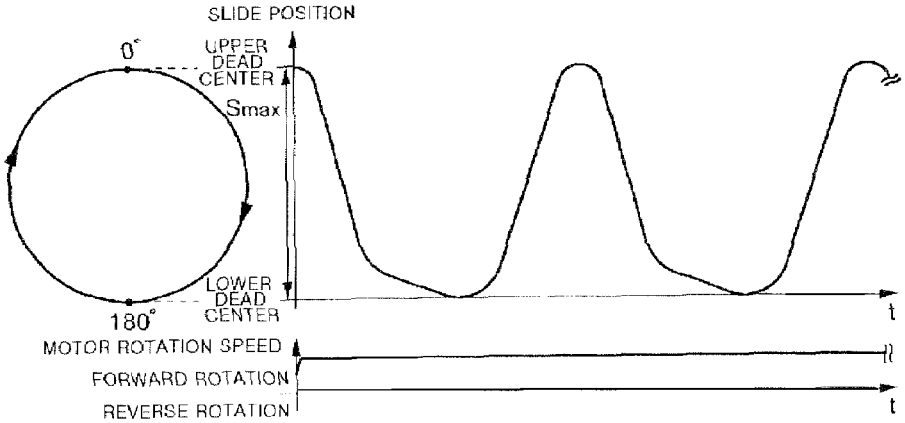
Figure 5:
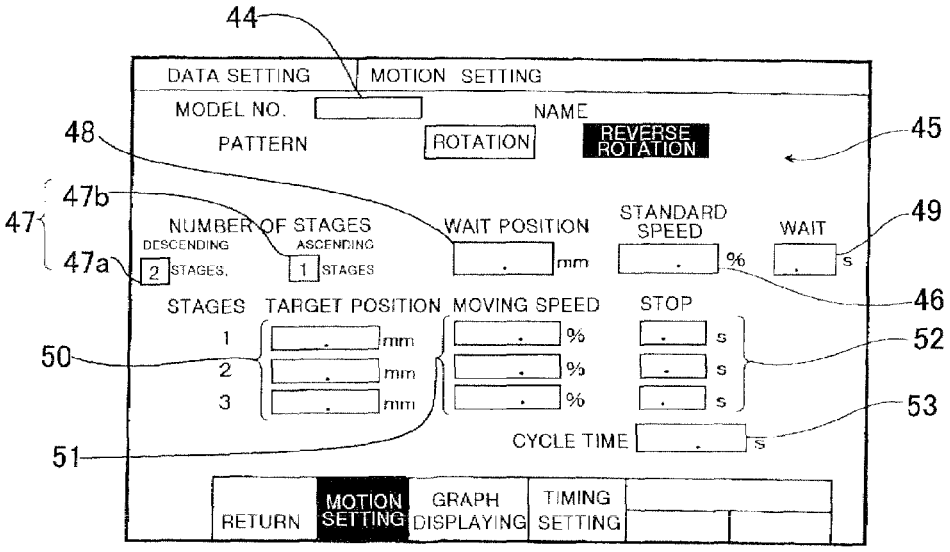
FIG. 5 is a diagram (FIG. 5(*a*)) showing, as an example, a motion setting screen for a "reverse rotation" pattern according to the first embodiment and an explanatory diagram (FIG. 5(*b*)) showing an operation in the "reverse rotation" pattern.
Figure 5:
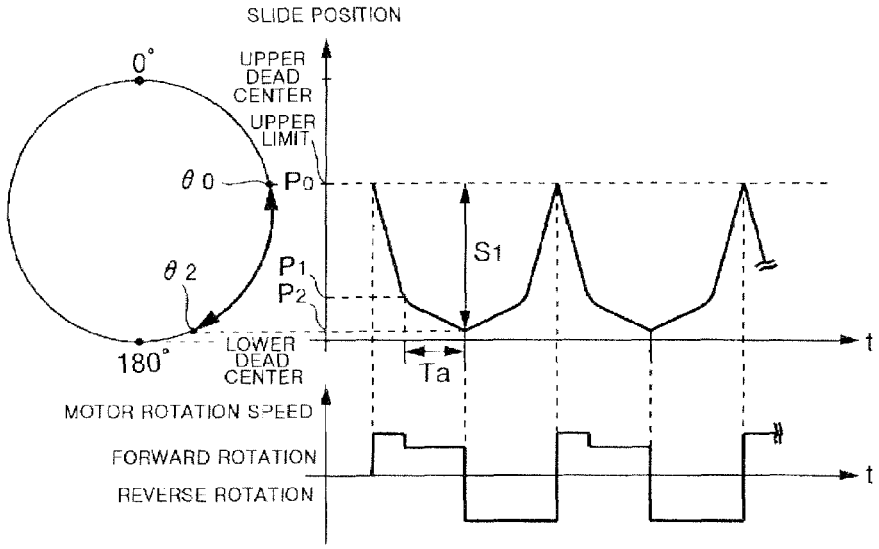

FIG. 4 is a diagram (FIG. 4(*a*)) showing, as an example, a motion setting screen for a "rotation" pattern according to the first embodiment and an explanatory diagram (FIG. 4(*b*)) showing an operation in the "rotation" pattern. FIG. 5 is a diagram (FIG. 5(*a*)) showing, as an example, a motion setting screen for a "reverse rotation" pattern according to the first embodiment and an explanatory diagram (FIG. 5(*b*)) showing an operation in the "reverse rotation" pattern. The circles on the left sides of FIGS. 4(*b*) and 5(*b*) represent the rotational movement of the gear 26, respectively. The rotation angle of the gear 26 corresponding to the upper dead center is 0 degree and the rotation angle of the gear 26 corresponding to the lower dead center is 180 degrees. The time charts on the right sides of FIGS. 4(*b*) and 5(*b*) represent the changes in the position of the slide caused by the rotational movement of the gear 26, and time is plotted on the abscissa whereas the position (height) of the slide is plotted on the ordinate.

(Explanation of "Rotation" Pattern)

Since motion data is individually set for every die, the model number 44 of each die is indicated on the screen shown in FIG. 4(*a*). In a method setting unit 45, either one of the slide control patterns "rotation" and "reverse rotation" can be selected. If the operator touches either of transparent touch switches indicative of pattern names, that is, the "rotation" pattern and "reverse rotation" pattern respectively, the pattern name corresponding to the touched switch is highlighted (In FIG. 4(*a*), "rotation" is highlighted), and then, the corresponding pattern is selected. If the "rotation" pattern is selected, the setting unit for a standard speed 46 is displayed on the screen. The standard speed 46 represents the permissible maximum speed of the servo motor 21 in this motion. In this embodiment, the standard speed of the servo motor is expressed as a percentage (maximum value is 100%) of a predetermined maximum servo motor speed. This prevents setting of a speed exceeding the maximum servo motor speed.

As shown in FIG. 4(*b*), in the "rotation" pattern, the servo motor 21 is continuously rotated at a specified constant speed (i.e., a set value of the standard speed 46 which is usually the maximum speed of the servo motor) in a forward rotating direction. Thereby, the motion curve of the slide becomes a link motion dependent on mechanical dimensions such as the eccentricity of the eccentric shaft 28, the length of each link of the toggle linkage 15, and the relationship between the center of the rotation of the eccentric shaft 28 and the toggle linkage 15. In this motion, the slide 3 moves gently in an descending stroke from the upper dead center to the lower dead center and at high speed in an ascending stroke that follows the descending stroke. The stroke length of the slide is the maximum stroke length $S_{max}$ that is determined depending on the mechanical dimensions described above.

(Explanation of "Reverse Rotation" Pattern)

As shown in FIG. 5(*b*), in the "reverse rotation" pattern, the forward rotation speed of the servo motor 21 is controlled in a region which ranges from the rotation angle $\theta_0$ of the gear 26 corresponding to an upper limit position $P_0$ set between the upper dead center and the lower dead center to the rotation angle $\theta_2$ of the gear 26 corresponding to a lower limit position $P_2$ set just before the lower dead center, and then the slide 3 is accurately positioned and stopped at the lower limit position $P_2$. Thereafter, the rotation of the servo motor 21 is reversed to raise the slide 3 to and stop it at the upper limit position $P_0$. This is repeated, thereby repeating the upward and downward movement of the slide 3 with a short stroke $S_1$, so that the slide 3 can be positioned at the lower limit position $P_2$ with high accuracy.

As illustrated in FIG. 5(*a*), in the set screen of the "reverse rotation" pattern, the number of stages 47, wait position 48, standard speed 46, wait time 49, and target position 50, moving speed 51 and stop time 52 for each stage can be set for each die, so that a desired motion can be flexibly set in accordance with the types of dies. In the number of stages 47, the number of stages 47*a* in the speed control zone of the descending stroke and the number of stages 47*b* in the speed control zone of the ascending stroke are displayed. If the number of stages 47*a* and the number of stages 47*b* are respectively set to 1, a link motion under specified constant speed control is set. In the example shown in FIG. 5(*a*), since the number of stages 47*a* in the descending stroke is set to 2 and the number of stages 47*b* in the ascending stroke is set to 1, the descending stroke has two stages of speed control zones whereas the ascending stroke is a link motion by reverse rotation of the motor under specified constant speed control. The wait position 48 is the last slide position in the ascending stroke, that is, the upper limit position. In the example shown in FIG. 5(*b*), the wait position is the upper limit position $P_0$. The wait time 49 is the time during which the slide 3 stops at the wait position 48 (until the next cycle starts). In the example shown in FIG. 5(*b*), the wait time=0. The target position 50 for each stage means the last slide position in each stage (which is also a starting position for the succeeding stage). In the example shown in FIG. 5(*b*), the first stage in the descending stroke is a target position $P_1$, the second stage in the descending stroke is a target position $P_2$ (lower limit position), and the ascending stroke (the third stage shown in the drawing) is a target position $P_0$ (upper limit position). The moving speed 51 for each stage is the moving speed of the slide traveling in the zone of each stage and the stop time 52 for each stage is the time at which the movement stops at the final target position Pn. In the example shown in FIG. 5(*b*), the moving speed 51 for the second stage corresponds to the inclination of the motion from $P_1$ to $P_2(=(P_1-P_2)/Ta)$ and the stop time 52 is zero. In this embodiment, the ascending stroke is set such that the slide 3 rises from the lower limit position $P_2$ to the upper limit position $P_0$ at the maximum speed (100%). The moving speed 51 for each stage is expressed as a percentage of the maximum slide speed corresponding to the standard speed 46 of the set motion. After completion of the above setting, a cycle time is automatically calculated based on the set data and the result of the calculation is displayed on a cycle time display unit 53.

The controller 42 has a computer system chiefly composed of a microcomputer, high-speed numerical data processor or the like. As shown in FIG. 3, the controller 42 includes various operation parts, i.e., a memory 55, a motion setting unit 56, a slide position command computing unit 57, a slide position deviation computing unit 58, a positional gain computing unit 59 and a motor speed instructing unit 60.

The memory 55 stores motion data set by the motion setting means 41 in correspondence with its associated model number 44 (see FIGS. 4(*a*), 5(*a*)) and stores, for slide control, data on the relationship between the rotation angle of the servo motor 21 (the rotation angle of the gear 26) and the position of the slide. The data on the relationship between the rotation angle of the servo motor 21 (the rotation angle of the gear 26) and the position of the slide is obtained by a function expression determined by mechanical dimensions such as the lengths of the links 12*a*, 12*b*, 13 of the toggle linkage 15, the eccentricity of the eccentric shaft 28, and the relationship between the center of rotation of the eccentric shaft 28 and the toggle linkage 15. The function expression may be stored as it is or, alternatively, in the form of table data.

The motion setting unit 56 has the function of determining a motion representative of the relationship between control execution time t and slide position P based on a slide control pattern set by the motion setting means 41 and motion data corresponding to the slide control pattern.

The slide position command computing means 57 has the function of calculating a slide position command (rp) for every predetermined servo cycle time so as to move the slide 3 according to the slide motion set by the motion setting unit 56.

The slide position deviation computing means 58 has the function of calculating the deviation ($\epsilon$ p) of the position of the slide 3 indicated by a slide position detection signal (Sp) output from the slide position sensor 33 from the slide position command (rp) output from the slide position command computing means 57.

Figure 6:
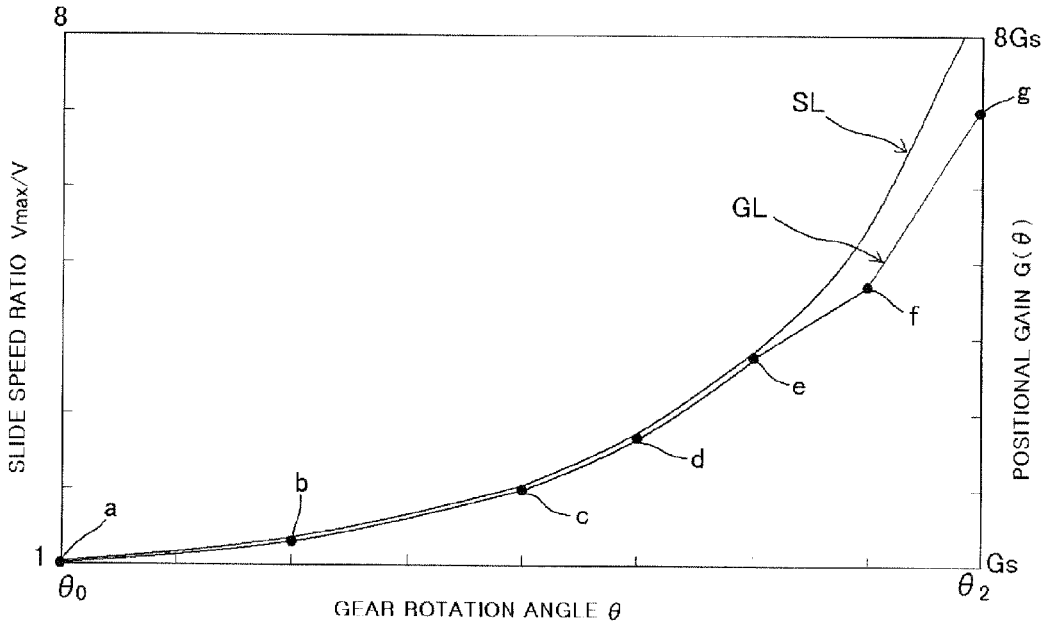
FIG. 6 is a graph of the relationship between the speed ratio of a slide, the rotation angle of a gear and positional gain.

Incidentally, since the speed ratio of the slide 3 changes, as indicated by the slide speed ratio curve SL in FIG. 6, in relation to changes in the posture of the toggle linkage 15, that is, changes in the rotation angle θ of the gear 26, the deviation of the position of the slide 3 relatively decreases as the slide 3 approaches to the stroke lower limit position $P_2$ (see FIG. 5(*b*)). In order to compensate the relative decreases in the deviation of the position of the slide 3, the first embodiment is designed such that the positional gain curve marked with GL in FIG. 6 is set and the positional gain G(θ) relating to the calculation of a motor speed command is varied based on the rotation angle θ of the gear 26. It should be noted that the speed ratio of the slide 3 as stated herein is the ratio (Vmax/V) between the speed V of the slide 3 at a certain time point when the rotation speed of the servo motor 21 is constant, that is, when the gear 26 is activated at a constant rotation speed and the maximum speed Vmax of the slide 3 obtainable by the above rotation speed. Symbol Gs in FIG. 6 indicates a reference set value for the positional gain.

As shown in FIG. 6, the positional gain curve GL is a curve obtained by linear interpolation of a desired number of switching points (points a to g on the curve GL) of the positional gain G(θ) relative to the rotation angle θ of the gear 26, these switching points being set in proximity to a slide speed ratio curve SL. The positional gain curve GL is stored in the form of a table in the memory 55. The rotation speed of the servo motor 21 has stepped regions in some cases depending on setting of the positional gain so that the value of torque current reversely changes with suddenness from the plus side to the minus side and at that time, a big abnormal sound may occur within the power transmission path on the downstream side of the servo motor 21. The occurrence of such an abnormal sound is thought to be attributable to unsmooth switching of the positional gain or setting of the positional gain curve out of line with the slide speed ratio curve SL. In the first embodiment, the above problem is overcome by making the bent portions (the areas near the switching points b to f) of the positional gain curve GL obtuse as much as possible and setting the positional gain curve GL such that it invariably extends under and along with the slide speed ratio curve SL. In this way, variations in the rotation speed of the motor and torque current are reduced, thereby reducing abnormal sounds occurring in the power transmission path.

The positional gain computing unit 59 has the following function. Specifically, the positional gain computing unit 59 reads the table data of the positional gain (θ) shown in FIG. 6 from the memory 55 and obtains the rotation angle θ of the gear 26 having a linear relation with the rotation angle of the servo motor 21 in response to a signal from a rotary encoder 61 for detecting the rotation angle and rotation speed of the servo motor 21. Then, it calculates the positional gain G(θ) corresponding to the speed ratio of the slide 3, by looking up the positional gain curve GL with the obtained rotation angle θ of the gear 26.

The motor speed instructing unit 60 inputs the positional gain G(θ) from the positional gain computing unit 59 and functions to calculate a motor speed command rm based on this positional gain G(θ) and a slide position deviation $\epsilon$ p output from the slide position deviation computing unit 58.

The servo amplifier 43 calculates the deviation $\epsilon$ s of a feedback value Sθ of a motor rotation speed output from the rotary encoder 61 from the motor speed command rm output from the motor speed instruction unit 60 and functions to control the rotation of the servo motor 21 by controlling a motor current Cm based on the calculated motor speed deviation ϵ S.

Figure 7:
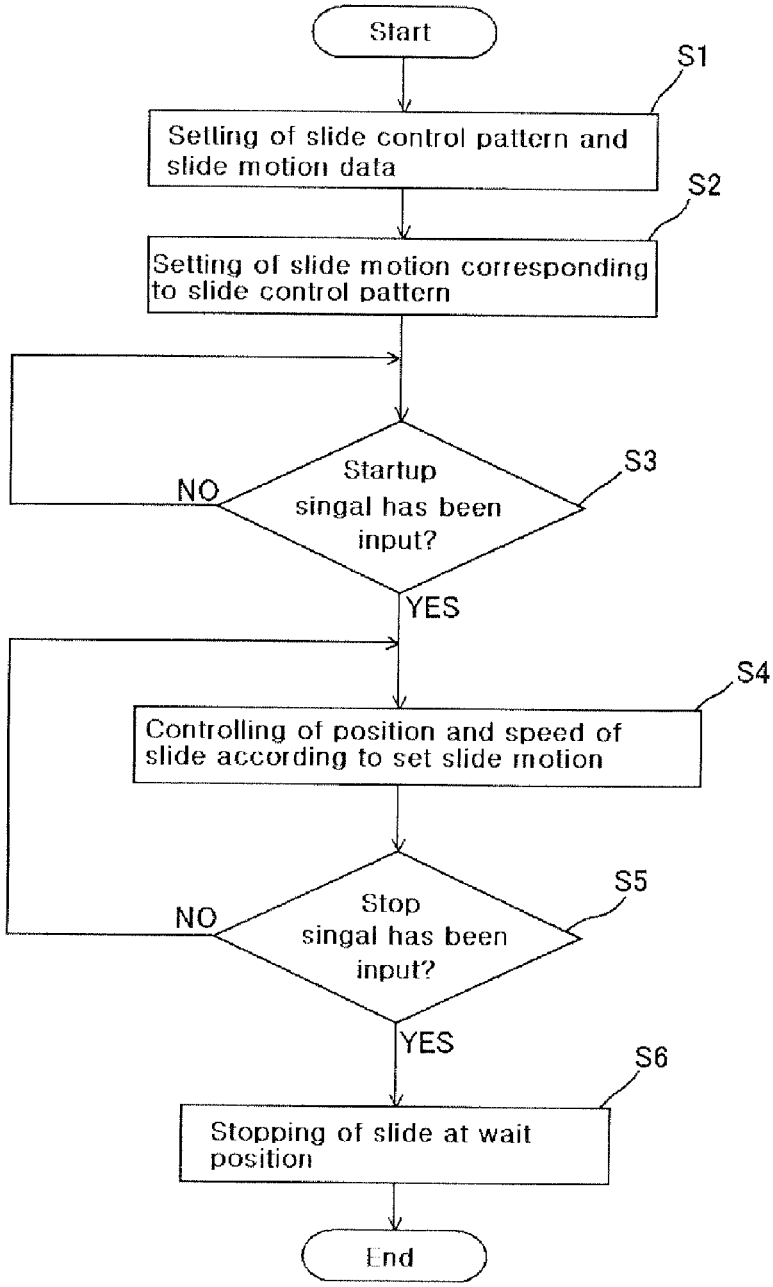
FIG. 7 is a flow chart of the operation of the servo press control system according to the first embodiment.

FIG. 7 is a flow chart of the operation of the servo press control system according to the first embodiment. With reference to the flow chart of FIG. 7, the operation of the control system 40 will be described below.

S1 to S3: First, the motion setting means 41 sets, as the contents of operation to be executed, a slide control pattern ("rotation" pattern or "reverse rotation" pattern) selected by the operator and slide motion data which meets processing conditions set according to the selected slide control pattern (S1). Then, the motion setting unit 56 applies the slide motion data set in Step S1 to the slide control pattern selected and set in Step S1, thereby setting a slide motion corresponding to the slide control pattern (S2). Subsequently, a check is made to determine whether a startup signal has been input to the controller 42 (S3) and if not, Step S3 is repeated until a startup signal is input. Herein, the startup signal may be output from a startup button switch provided in the operation panel (not shown) of the press or from a high-order press line management controller (not shown).

S4: If it is determined in Step S3 that a startup signal has been input to the controller 42, the position and speed of the slide 3 is controlled such that the slide 3 moves according to the slide motion set in Step S2.

Specifically, if the slide motion set in Step S2 is the slide motion shown in FIG. 4(*b*), in other words, if the slide control pattern set in Step 1 is the "rotation" pattern, the slide position command computing unit 57 calculates a slide position command for every specified servo cycle time such that the slide 3 moves in accordance with the slide motion shown in FIG. 4(*b*) and outputs this slide position command to the motor speed instructing unit 60. The motor speed instructing unit 60 outputs a motor speed command to the servo amplifier 43, the motor speed command being calculated by multiplying the slide position deviation (i.e., the deviation of the slide position detection signal output from the slide position sensor 33 from the slide position command output from the slide position command computing unit 57) by a specified positional gain. The servo amplifier 43 controls the motor speed current based on the deviation of a motor rotation speed detected by the rotary encoder 61 from the motor speed command output from the motor speed instructing unit 60, thereby controlling the rotation of the servo motor 21. The servo motor 21 under such rotation control activates the eccentric rotation mechanism 20 the rotating power of which is, in turn, transmitted to the slide 3 through the toggle linkage 15 so that the slide 3 moves in accordance with the slide motion shown in FIG. 4(*b*).

If the slide motion set in Step S2 is the slide motion shown in FIG. 5(*b*), that is, if the slide control pattern set in Step S1 is the "reverse rotation" pattern, the slide position command computing unit 57 calculates a slide position command rp for every specified servo cycle time such that the slide 3 moves in accordance with the slide motion shown in FIG. 5(*b*) and outputs this slide position command rp to the motor speed instructing unit 60. The motor speed instructing unit 60 outputs the motor speed command rm to the servo amplifier 43, the motor speed command rm being calculated based on the deviation ϵ p of the slide position detection signal Sp output from the slide position sensor 33 from the slide position command rp output from the slide position command computing unit 57 and based on the positional gain G(θ) calculated in the positional gain computing unit 59. The servo amplifier 43 controls the motor speed current Cm based on the deviation ϵ s of a motor rotation speed Sθ detected by the rotary encoder 61 from the motor speed command rm output from the motor speed instructing unit 60, thereby controlling the rotation of the servo motor 21. The servo motor 21 under such rotation control activates the eccentric rotation mechanism 20 the rotating power of which is, in turn, transmitted to the slide 3 through the toggle linkage 15 so that the slide 3 moves in accordance with the slide motion shown in FIG. 5(*b*).

S5 to S6: A check is made to determine whether a stop signal has been released from the operation panel of the press, the press line management controller or the like (S5), and if no, the processes in Steps S4 and S5 are repeated until a stop signal is released. Upon release of a stop signal, the slide 3 is stopped at the upper limit position or upper dead center set as the wait position, thereby stopping the operation of the press (S6).

According to the first embodiment, when selecting and setting the "rotation" pattern as the slide control pattern, the slide 3 can be moved up and down at high speed with the continuous rotation of the servo motor 21 so that high production processing can be properly performed. When selecting and setting the "reverse rotation" pattern as the slide control pattern, the rotation of the servo motor 21 is controlled by the motor speed command rm which is calculated based on the positional deviation ϵ p of the slide 3 and the positional gain G(θ) corresponding to the speed ratio of the slide 3. Therefore, the slide 3 can be accurately positioned at the lower limit position $P_2$, so that high accuracy processing applicable to coining and precision molding, which require high accuracy in positioning the slide at the lower limit position, can be properly performed. Accordingly, the first embodiment has the effect of selectively performing high production processing and high accuracy processing with a single press.

Second Embodiment

Figure 8:
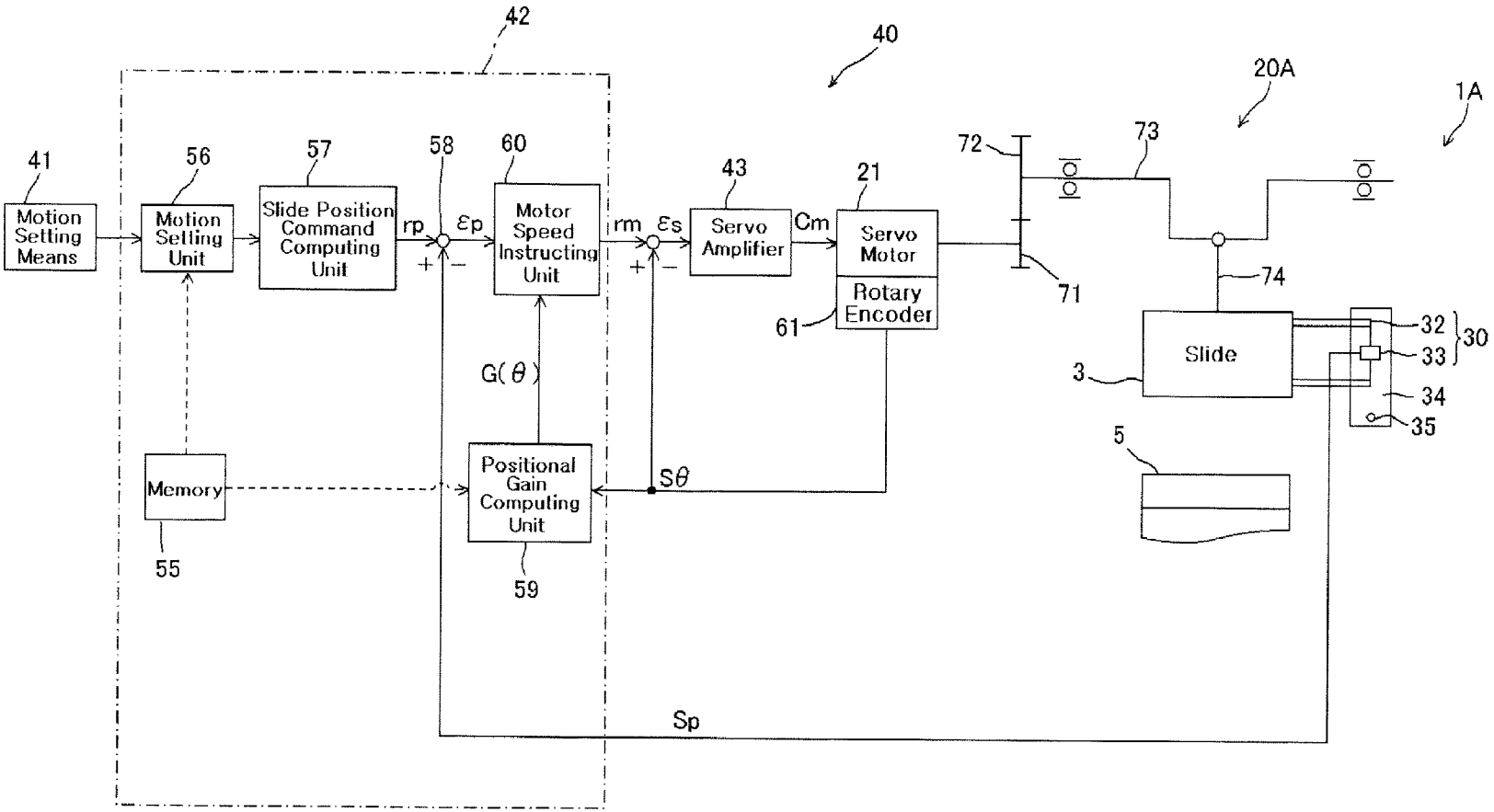
FIG. 8 is a schematic system configuration diagram of a servo press according to a second embodiment of the invention.
Figure 9:
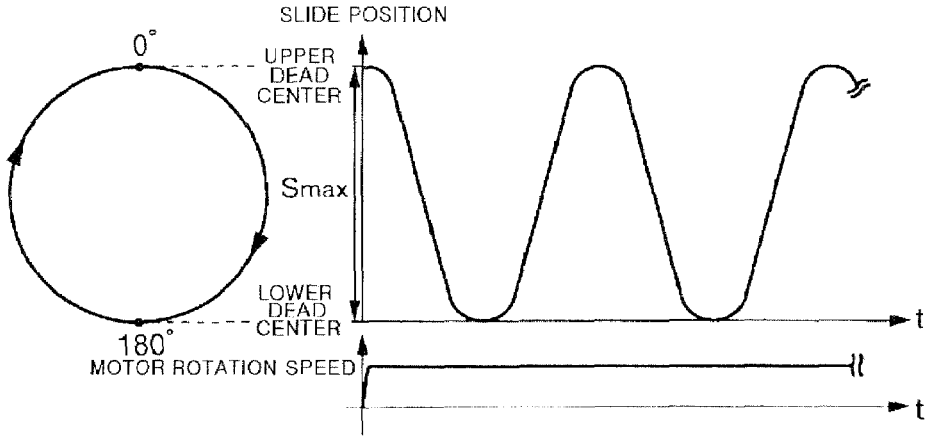
FIG. 9 is an explanatory diagram (FIG. 9(*a*)) showing an operation in a "rotation" pattern according to the second embodiment and an explanatory diagram (FIG. 9(*b*)) showing an operation in a "reverse rotation" pattern according to the second embodiment.
Figure 9:
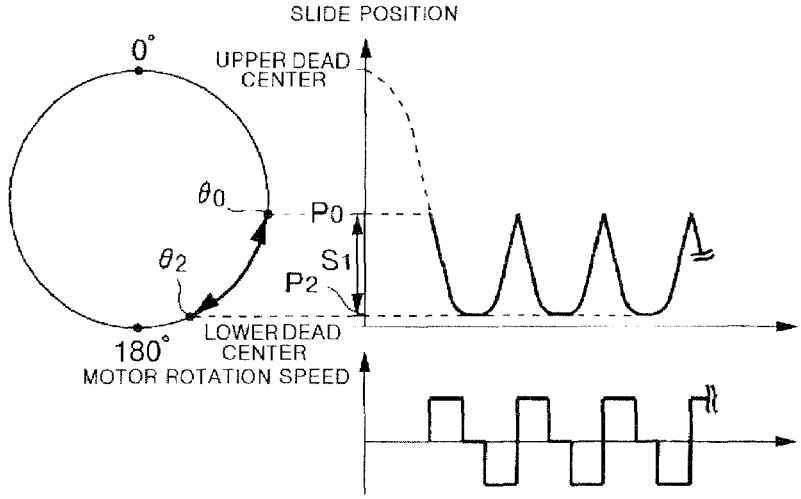

FIG. 8 is a schematic system configuration diagram of a servo press according to a second embodiment of the invention. FIG. 9 is an explanatory diagram (FIG. 9(*a*)) showing an operation in a "rotation" pattern according to the second embodiment and an explanatory diagram (FIG. 9(*b*)) showing an operation in a "reverse rotation" pattern according to the second embodiment. The circles on the left sides of FIGS. 9(*a*), 9(*b*) respectively represent the rotational movement of a gear 72 (described later), and the rotation angle of the gear 72 corresponding to the upper dead center is 0 degree whereas the rotation angle of the gear 72 corresponding to the lower dead center is 180 degrees. The time charts on the right sides of FIGS. 9(*b*) and 9(*b*) respectively represent changes in the position of the slide caused by the rotational movement of the gear 72, and time is plotted on the abscissa whereas the position (height) of the slide is plotted on the ordinate. In the second embodiment, the part thereof that are substantially equivalent to those of the first embodiment are identified by the same reference numerals and a detailed description thereof is omitted. In the following description, the points differing from the first embodiment will be mainly explained.

FIG. 8 shows a servo press 1A in which the rotating power of the servo motor 21 is transmitted to a crank shaft 73 through a gear 71 attached to the output shaft of the servo motor 21 and the gear 72 meshing with the gear 71. Thus, an eccentric rotation mechanism 20A is constituted by a power transmission mechanism which extends from the output shaft of the servo motor 21 to the crank shaft 73. The slide 3 is vertically movably coupled to the crank shaft 73 through a connecting rod 74. The rotating power of the servo motor 21 transmitted to the crank shaft 73 causes the slide 3 to move up and down.

In the second embodiment, the memory 55 in the controller 42 stores the data on the relationship between the rotation angle of the servo motor 21 (i.e., the rotation angle of the gear 72) and the position of the slide 3. This relationship data is obtained from the trigonometric function of the eccentricity (the turning radius of the crank shaft 73) of the crank shaft mechanism, the length of the connecting rod 74 and the rotation angle of the crank shaft 73 (the rotation angle of the gear 72). This function expression may be stored as it is or, alternatively, in the form of table data.

If the slide control pattern set by the motion setting means 41 is the "rotation" pattern, the motion setting unit 56 sets the slide motion shown in FIG. 9(*a*). On the other hand, if the slide control pattern set by the motion setting means 41 is the "reverse rotation" pattern, the motion setting unit 56 sets the slide motion shown in FIG. 9(*b*).

If the controller 42 inputs a startup signal on the condition that the motion setting means 41 has selected and set the "rotation" pattern as the slide control pattern and the motion setting unit 56 has set the slide motion shown in FIG. 9(*a*), the slide position command computing unit 57 calculates a slide position command for every specified servo cycle time such that the slide 3 moves in accordance with the slide motion shown in FIG. 9(*a*) and outputs this slide position command to the motor speed instructing unit 60. The motor speed instructing unit 60 outputs a motor speed command to the servo amplifier 43, the motor speed command being calculated by multiplying a slide position deviation (i.e., the deviation of a slide position detection signal output from the slide position sensor 33 from the slide position command output from the slide position command computing unit 57) by a specified positional gain. The servo amplifier 43 controls the motor speed current based on the deviation of a motor rotation speed detected by the rotary encoder 61 from the motor speed command output from the motor speed instructing unit 60, thereby controlling the rotation of the servo motor 21. The servo motor 21 under such rotation control activates the eccentric rotation mechanism 20A the rotating power of which is, in turn, transmitted to the slide 3 through the connecting rod 74 so that the slide 3 moves in accordance with the slide motion shown in FIG. 9(*a*).

On the other hand, if the controller 42 inputs a startup signal on the condition that the motion setting means 41 has selected and set the "reverse rotation" pattern as the slide control pattern and the motion setting unit 56 has set the slide motion shown in FIG. 9(*b*), the slide position command computing unit 57 calculates a slide position command rp for every specified servo cycle time such that the slide 3 moves in accordance with the slide motion shown in FIG. 9(*b*) and outputs this slide position command rp to the motor speed instructing unit 60. The motor speed instructing unit 60 outputs a motor speed command rm to the servo amplifier 43, the motor speed command rm being calculated based on the deviation $\epsilon$ p of a slide position detection signal Sp output from the slide position sensor 33 from the slide position command rp output from the slide position command computing unit 57 and based on a positional gain G(θ) calculated in the positional gain computing unit 59. The servo amplifier 43 controls a motor speed current Cm based on the deviation $\epsilon$ s of a motor rotation speed Sθ detected by the rotary encoder 61 from the motor speed command rm output from the motor speed instructing unit 60, thereby controlling the rotation of the servo motor 21. The servo motor 21 under such rotation control activates the eccentric rotation mechanism 20A the rotating power of which is, in turn, transmitted to the slide 3 through the connecting rod 74 so that the slide 3 moves in accordance with the slide motion shown in FIG. 9(*b*).

According to the second embodiment, when selecting and setting the "rotation" pattern as the slide control pattern, the slide 3 can be moved up and down at high speed with the continuous rotation of the servo motor 21 so that high production processing can be performed. When selecting and setting the "reverse rotation" pattern as the slide control pattern, the rotation of the servo motor 21 is controlled by the motor speed command rm which is calculated based on the positional deviation $\epsilon$ p of the slide 3 and the positional gain G(θ) corresponding to the speed ratio of the slide 3. Therefore, the slide 3 can be accurately positioned at the lower limit position $P_2$, so that high accuracy processing applicable to coining and precision molding, which require high accuracy in positioning the slide at the lower limit position, can be properly performed. Accordingly, the second embodiment has the effect of selectively performing high production processing and high accuracy processing with a single press.

The invention claimed is:

1. A system for controlling a servo press in which an eccentric rotation mechanism is driven by a servo motor, the rotation of which is controlled by a servo amplifier which receives a motor speed command, and the rotating power of the eccentric rotation mechanism is transmitted to a slide through a connecting rod or linkage, thereby vertically moving the slide, comprising:

(a) a slide position detector for detecting a position of the slide;

(b) a slide position deviation computing unit for calculating deviation of the slide position detected by the slide position detector from a target slide position;

(c) a positional gain computing unit for calculating a positional gain according to a speed ratio of the slide; and (d) a motor speed instructing unit for calculating a motor speed command based on the slide position deviation calculated by the slide position deviation computing unit and the positional gain calculated by the positional gain computing unit and outputting the calculated motor speed command to the servo amplifier.

2. A method for controlling a servo press in which an eccentric rotation mechanism is driven by a servo motor and rotating power of the eccentric rotation mechanism is transmitted to a slide through a connecting rod or linkage, thereby vertically moving the slide, wherein rotation of the servo motor is controlled in response to a motor speed command calculated based on deviation of a position of the slide and a positional gain corresponding to a speed ratio of the slide.

* * * * *